US011602204B2

(12) United States Patent
Fraiman et al.

(10) Patent No.: US 11,602,204 B2
(45) Date of Patent: Mar. 14, 2023

(54) FOLDABLE SUITCASE

(71) Applicant: Rollink Smart Products LTD, Hetzelia Pituah (IL)

(72) Inventors: Zvika Fraiman, Havatzelet Hasharon (IL); Nadin Daniel Horovitz, Tel Aviv (IL); Orit Schnitzer, Qyriat Ono (IL); Eyal Azoulay, Netanya (IL)

(73) Assignee: ROLLINK SMART PRODUCTS LTD, Hertzelia Pituah (IL)

( * ) Notice: Subject to any disclaimer, the term of this patent is extended or adjusted under 35 U.S.C. 154(b) by 0 days.

(21) Appl. No.: 17/640,505

(22) PCT Filed: Sep. 9, 2020

(86) PCT No.: PCT/IL2020/050980

§ 371 (c)(1),
(2) Date: Mar. 4, 2022

(87) PCT Pub. No.: WO2021/048843

PCT Pub. Date: Mar. 18, 2021

(65) Prior Publication Data

US 2022/0287425 A1 Sep. 15, 2022

(30) Foreign Application Priority Data

Sep. 9, 2019 (IL) ..... 269221

(51) Int. Cl.

| | |
|---|---|
| ***A45C 7/00*** | (2006.01) |
| ***A45C 5/03*** | (2006.01) |
| ***A45C 5/14*** | (2006.01) |
| ***A45C 13/26*** | (2006.01) |

(52) U.S. Cl.
CPC ..... *A45C 7/0036* (2013.01); *A45C 5/03* (2013.01); *A45C 5/14* (2013.01); *A45C 13/262* (2013.01); *A45C 2013/267* (2013.01)

(58) Field of Classification Search
CPC ... A45C 5/14; A45C 13/262; A45C 2001/267; A45C 5/03; A45C 7/007; A45C 2013/267
USPC ..... 190/18 A, 107
See application file for complete search history.

(56) References Cited

U.S. PATENT DOCUMENTS

| | | | | |
|---|---|---|---|---|
| 3,777,862 | A * | 12/1973 | Zipper | A45C 3/004 190/107 |
| 6,179,111 | B1 * | 1/2001 | Ratz | B65H 29/60 271/204 |
| 6,443,274 | B1 | 9/2002 | Klamm | |
| 6,883,654 | B2 | 4/2005 | Godshaw et al. | |
| 8,365,886 | B2 | 2/2013 | Mehta | |
| 9,375,063 | B2 | 6/2016 | Chen | |
| 9,681,717 | B2 | 6/2017 | Meersschaert | |

(Continued)

FOREIGN PATENT DOCUMENTS

| | | |
|---|---|---|
| CN | 202124157 U | 1/2012 |
| CN | 204105120 U | 1/2015 |

(Continued)

OTHER PUBLICATIONS

Travel Star Foldable Trolley Luggage with 2 Wheels https://www.youtube.com/watch?v=zKY5W8OWniM (Captured Mar. 4, 2022).

*Primary Examiner* — Sue A Weaver
(74) *Attorney, Agent, or Firm* — Cantor Colburn LLP

(57) ABSTRACT

The present disclosure concerns a suitcase, and more particularly a foldable suitcase.

21 Claims, 15 Drawing Sheets

(56) References Cited

U.S. PATENT DOCUMENTS

| | | | | |
|---|---|---|---|---|
| 9,706,821 | B2 | 7/2017 | Tseng et al. | |
| 2007/0152009 | A1 | 7/2007 | Fishman | |
| 2015/0114776 | A1* | 4/2015 | Mathieu | A45C 7/0036 190/127 |
| 2017/0042301 | A1* | 2/2017 | Armani | A45C 7/0036 |
| 2018/0014614 | A1 | 1/2018 | Marshall | |

FOREIGN PATENT DOCUMENTS

| | | | |
|---|---|---|---|
| CN | 206485707 | U | 9/2017 |
| CN | 206651481 | U | 11/2017 |
| CN | 209080422 | U | 7/2019 |
| EP | 1375362 | | 1/2004 |
| WO | WO2019017821 | | 1/2019 |

* cited by examiner

FOLDABLE SUITCASE

TECHNOLOGICAL FIELD

The present disclosure concerns a suitcase, and more particularly a foldable suitcase.

BACKGROUND ART

References considered to be relevant as background to the presently disclosed subject matter are listed below:

CN209080422U

CN202124157U

Acknowledgement of the above references herein is not to be inferred as meaning that these are in any way relevant to the patentability of the presently disclosed subject matter.

BACKGROUND

CN209080422U discloses an integrally formed foldable container. The container has panels that are connected by hinges and some adjacent panels are connected by ears. By collectively rearranging the panels, the container can collapse into a generally flat collapsed configuration.

CN202124157U discloses a folding gift box, which comprises a front board, a bottom board, a rear board, an upper cover board and an upper cover flap in sequential connection to form a rectangular board. The bottom board and the upper cover board are rectangular boards of a box body board portion, a box side board portion comprises a left board, a right board, a left front triangular folding board and a right front triangular folding board, and the left front triangular folding board and the right front triangular folding board are folded by 45 degrees to be adhered to the inner face of a front board respectively, so that the left board is perpendicular to the box bottom board when the box is opened.

GENERAL DESCRIPTION

In one of its aspects, the present disclosure provides a collapsible suitcase comprising a rigid back wall configured with a handle assembly, a front wall, a top wall and a rigid base wall configurable at a bottom face thereof with a wheel set; the two side walls are pivotally articulated to the back wall through living hinges along respective side edges of said back wall, and the base wall is pivotally articulated to the back wall through a living hinge along a bottom edge of said back wall, and wherein a closure arrangement is configured for securing side edges of the base wall to bottom edges of the respective side walls, and side edges of the front wall to a front edge of the respective side walls, and side edges of the top wall to top edges of the respective side walls, and a back edge of the top wall to a top edge of the back wall. The suitcase further comprises an arresting arrangement disposed between the back wall and the base wall and configured for releasable securing the base wall at a substantially right angle with respect to the back wall, wherein the suitcase is configurable between an erect position at which at least the side walls and the base wall are disposed substantially perpendicular to the back wall, and a collapsed position at which all walls are disposed substantially at parallel planes.

According to embodiments of the disclosure, the top wall can extend from a top edge of the front wall. According to one configuration, the back edge of the top wall can extend from the top edge of the back wall, and according to another configuration, a bottom edge of the front wall can extend from a front edge of the base wall. According to yet an embodiment, the top wall extends from a top edge of the back wall and the front wall extends from a front edge of the base wall, and a front edge of the top wall is engageable by a closure to a top edge of the front wall.

The base wall is displaceable between an erect position at which it is disposed at a substantially right angle with respect to the back wall, and a collapsed position at which it displaceable between a first unlocked position coextending with the back wall and a second unlocked position folded over a bottom portion of the base wall.

The arresting arrangement is configured for selectively securing the base wall at a substantially right angle with respect to the back wall when the suitcase is at the erect position. The arresting arrangement is configurable between a locked position, at which the base wall is secured at a right angle with respect to the back wall, and an unlocked position, at which the base member is pivotally despicable between the erect position, and a flat position at which it can coextend with respect to the back wall.

According to embodiments of the disclosure, the arresting arrangement can be configured for spontaneously engaging into the locked position upon pivotal displacement of the base wall into the erect position.

The term rigid, as used herein refers to a rigid panel member or a rigid though pliable member. Even more so, a panel can be made of a rigid material, or can assume rigidity by applying thereto, fixedly or detachably, a rigidifying structure. The rigidifying structure can be a panel/board of material, a partial board or a truss, or a combination of board material and truss.

Any one or more of the following features, designs and configuration can be applied to a suitcase according to the present disclosure, separately or in various combining thereof:

- The arresting arrangement can be configured as a rigid arresting member, having a first edge articulated to a bottom edge of a side wall through a living hinge, and a second side articulated through a living hinge along a portion of the base wall and extending from a back corner of the base wall towards a front edge of the base wall, and wherein the length of the first side of the triangle does not exceed the depth of the base wall;
- The arresting member can be a triangular member or have a section of a triangular member;
- The triangular member can be an isosceles right triangular, wherein a hypotenuse of the triangular member extends from a bottom front corner of a side wall towards a front portion of the base wall;
- Deploying the side walls into the erect position can entail spontaneous displacement of the base wall into the erect position;
- The triangular member can be made of rigid member;
- A liner can extend between the base wall and the two side walls;
- The arresting member can be configured as a rectangle member having a diagonal living hinge defining a first triangular portion and a second triangular portion, wherein the first triangular portion overlaps a front-side portion of the base wall, and the second triangular portion has a first side that is articulated to a bottom edge of a side wall through a living hinge, and a second side thereof is free;
- The first triangular portion can be fixedly secured over a respective portion of the base wall;
- The arresting arrangement can be configured with a first locking member at a bottom portion of the back wall, and a second locking member at a back portion of the base wall, wherein one or both of the first locking member and the second locking member is (are) configured with an arresting location, and the other one or both of the first locking member and the second locking member is (are) configured with at least one locking plunger selectively manipulable between a locked position at which it engages with the arresting location, and an unlocked position at which it is disengaged from the arresting location, where at the locked position the base wall back wall is pivotally fixed with respect to the back wall;

The first locking member and the second locking member can be integral with or integrated with the respective wall portion, either directly or indirectly;

The first locking member and the second locking member can be disposed at respective inside faces of the suitcase;

The first locking member can be configured at a bottom portion of a handle assembly articulated to the back wall;

The arresting arrangement can be configured for spontaneously arresting of the at least one locking plunger with the arresting location upon displacement of the base wall into the erect position;

The arresting arrangement can comprise a biased locking plunger normally projecting from a housing member of the base wall, said locking plunger is configured for arresting engagement within an arresting location at a housing member of the back wall;

The housing member of the back wall can be a bottom portion of a handle assembly of the suitcase;

The one or more locking plungers can be manipulated to disengage from the arresting location at the housing member of the back wall from an inside of the suitcase;

The handle assembly can extend along the back wall and be configurable between a retracted position and an expanded position;

The handle assembly can be configured as a telescopic handle arrangement;

A bottom portion of the handle assembly is secured at a bottom portion of the back wall;

The wheel set can comprise at least a pair of wheels configurable at a back portion of a bottom face the base wall;

One or more of the wheels can be detachably attachable to a bottom face of the base wall;

One or more of the wheels can be free swivel wheels (casters); The wheel set can comprise four wheels disposable at respective corner portions of the base wall;

Wheels of the wheel set can be fixedly secured at a bottom face of the base wall or detachably attached thereto;

The suitcase can be configured out of a continuous single sheet;

The sheet can be configured with the two side walls extending from respective side edges of the back wall, the base wall extending from a bottom edge of the back wall, the front wall extending from a front edge of the base wall;

The top wall can extend from top edge of the front wall or from a top edge of the back wall;

One or more of the walls of the suitcase can be articulated to other walls of the suitcase through an integral or integrated living hinge;

One or more of the walls of the suitcase can be inherently rigid panels;

One or more of the walls of the suitcase can be soft/flexible panels rigidified by rigid panels attachable thereto;

The closure arrangement can be a set of clasps, latches, toggles, etc.;

The closure arrangement can be a zipper.

The zipper of the closure arrangement can be a zipper continuously extending along one or more edges of the suitcase;

The zipper can extend continuously at least along bottom and front edges of the side walls;

The zipper can extend continuously along bottom, front and top edges of the side walls and a top edge of the back wall;

The suitcase can be configured with a hanger for suspending the suitcase at the collapsed position;

The suitcase can be configured with a securing arrangement for securing the suitcase flat at the collapsed position;

According to a first collapsing configuration, at the collapsed position, the thickness of the suitcase substantially does not exceed accumulative thickness of the back wall and a side wall. According to a second collapsing configuration, at the collapsed position, the thickness of the suitcase substantially does not exceed accumulative thickness of the back wall, and a side wall and the front wall.

The suitcase can have any dimensions. According to one particular arrangement the suitcase is sized as a carry-on luggage as per airline requirements;

The foldable suitcase can be configured with two or more arresting arrangements, each of different mechanism;

Once the closure arrangement is securely closed, the foldable suitcase assumes a tight, three-dimensional configuration;

The foldable suitcase can be configured with a rigid back wall, two rigid (or rigidified) side walls and a rigid base wall, and with a flexible front wall and a flexible top wall, however wherein once the foldable suitcase is at the erect position and the closure arrangement is secured, the suitcase assumes a sturdy three-dimensional shape, with the flexible walls tensioned between edges of respective rigid walls, thus imparting the suitcase a sturdy erect position.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which:

FIGS. 9A to 9E are directed to a first example of an arresting arrangement useful with a foldable suitcase according to the disclosure, wherein:

FIG. 9A is a perspective view illustrating a base wall and a portion of a back wall arrested thereto at an upright position, with the arresting arrangement at a locked position;

FIG. 9B is an enlargement of the portion marked 'A', sectioned along line I-I, in FIG. 9A;

FIG. 9C is similar to FIG. 9A, however with the arresting arrangement at an unlocked position;

FIG. 9D is an enlargement of the portion marked 'B', sectioned along line II-II, in FIG. 9C;

FIG. 9E illustrates the assembly of FIG. 9A at a collapsed/folded position;

FIGS. 10A to 10E are directed to a second example of an arresting arrangement useful with a foldable suitcase according to the disclosure, wherein:

FIG. 10A illustrates a foldable suitcase according to an example of the disclosure, with a top wall a front wall and a bottom wall at an open position, and side walls collapsed over the back wall;

FIG. 10B illustrates the foldable suitcase of FIG. 10A with the side walls and base wall partially erect, and the arresting arrangement yet unlocked;

FIG. 10C illustrates the foldable suitcase of FIG. 10A with the side walls and base wall fully erect and the arresting arrangement locked;

FIG. 10D illustrates the suitcase of FIG. 10C at an upright position;

FIG. 10E is a back, perspective view illustrating the foldable suitcase of FIG. 10A at a fully erect, closed position, and a telescopic handle withdrawn.

DETAILED DESCRIPTION OF EMBODIMENTS

Figure 1A:
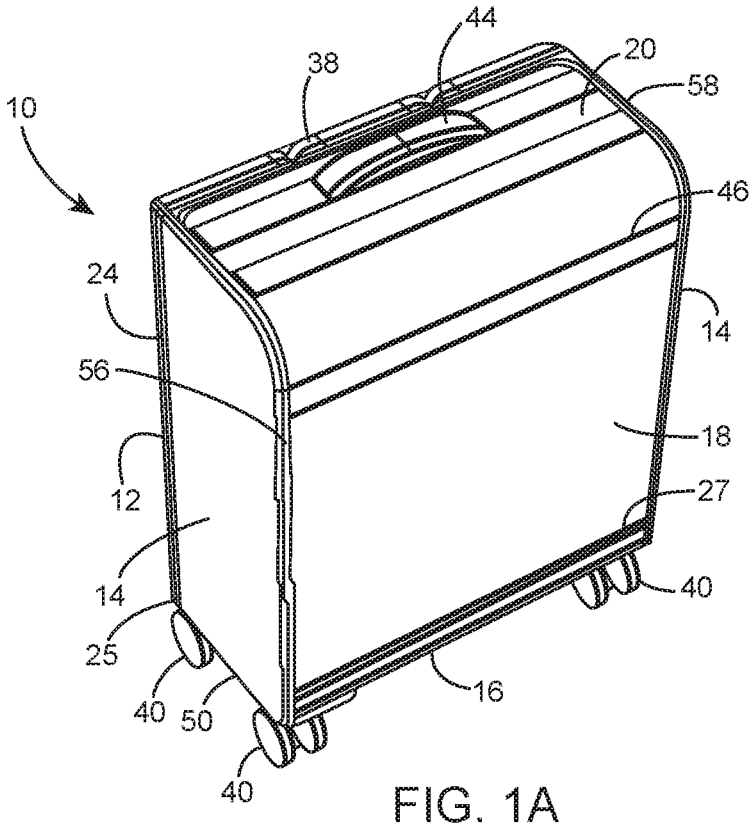
FIG. 1A is a front perspective of a foldable suitcase according to an example of the disclosure, at a closed, upright position.

Attention is first directed to FIGS. 1A to 8C, directed to a foldable suitcase according to the disclosure, generally designated 10. The suitcase 10 comprises a back wall 12, two parallelly disposed side walls 14, a base wall 16, a front wall 18 and a top wall 20.

The back wall 12 is made of rigid material, or it can be rigidified by an associated rigid supporting panel articulated thereto, and likewise, the side walls 14 are either made of rigid material or are rigidified by an associated rigid supporting panel, as will be discussed and exemplified herein after. The base wall 16 too is a rigid wall panel.

The two side walls 14 are pivotally articulated to the back wall 12 by a 'living hinge' 24 extending along the common longitudinal back edge of the side walls 14 and the side edges of the back wall 12, whereby the side walls are foldable between an erect position (extending perpendicular to said back wall 12 and parallel to one another; FIGS. 1A to 3), and a folded, collapsed position (disposed parallel to one another and flush against at least portions of an inside face 28 of the back wall 12; FIGS. 4A-5D).

Further noted, the back wall 12 of the foldable suitcase 10 is configured with a telescopic pull/push handle assembly 32, of known design (seen retracted in all FIGS., save in FIGS. 10E and 10F), said telescopic handle assembly 32 is configured with a pair of telescopically retractable legs 34 disposed along the inside face 28 of the back wall 12 (though often concealed by a liner), and configured with a manipulating handle 38 projecting from a top portion thereof.

The rigid base wall 16 is configurable with a wheel set, which in the present example is a set of four double wheeled casters 40 (free rotational about a support pin articulable to the base wall 16), wherein said wheels 40 can be fixedly secured to the external face of the base wall 16, or detachably attachable thereto.

The top wall 20 is a flexible sheet, extending from the flexible front wall 18, and configured with a carrying handle 44, fabricated with the external face of the top face 20.

In the illustrated example, the foldable suitcase 10 is configured such that the entire setup, i.e. all the walls (12, 14, 16, and 20) are made of a continuous, single sheet, and further the top wall 20 continuously extends from a top edge 46 of the front wall 18. Accordingly, respective walls are attached along respective edges in a foldable manner, by so called 'living hinges', wherein the back edges of the side walls 14 are attached to side edges of the back wall 12 along edge 24, a back edge of the base wall 16 is attached to a bottom edge of the back wall 12 along edge 25, a bottom edge of the front wall 18 is attached to a front edge of the base wall 16 along edge 27, and a front edge of the top wall 20 is attached to a top edge of the front wall 18 along top edge 46.

However, it is appreciated that according to another example (not shown) the top wall can extend from a top edge of the back wall, whilst the front wall extends from a front edge of the base wall, and further wherein a front edge of the top wall is engageable by a closure to a top edge of the front wall.

Figure 4A:
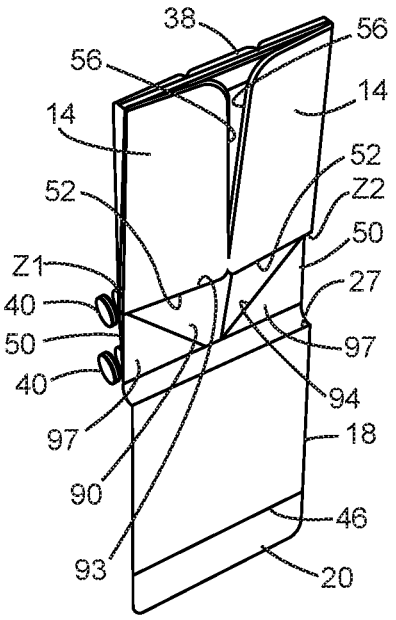
FIG. 4A is a front perspective view of the foldable suitcase of FIG. 1A, a top wall a front wall and a bottom wall at an open position, and side walls collapsed over the back wall.
Figure 4B:
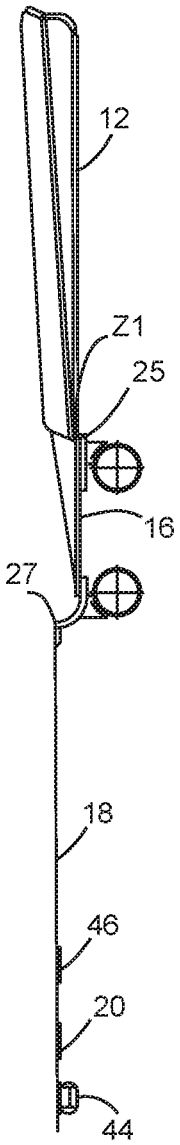
FIG. 4B is a right side view of the foldable suitcase of FIG. 4A.
Figure 4C:
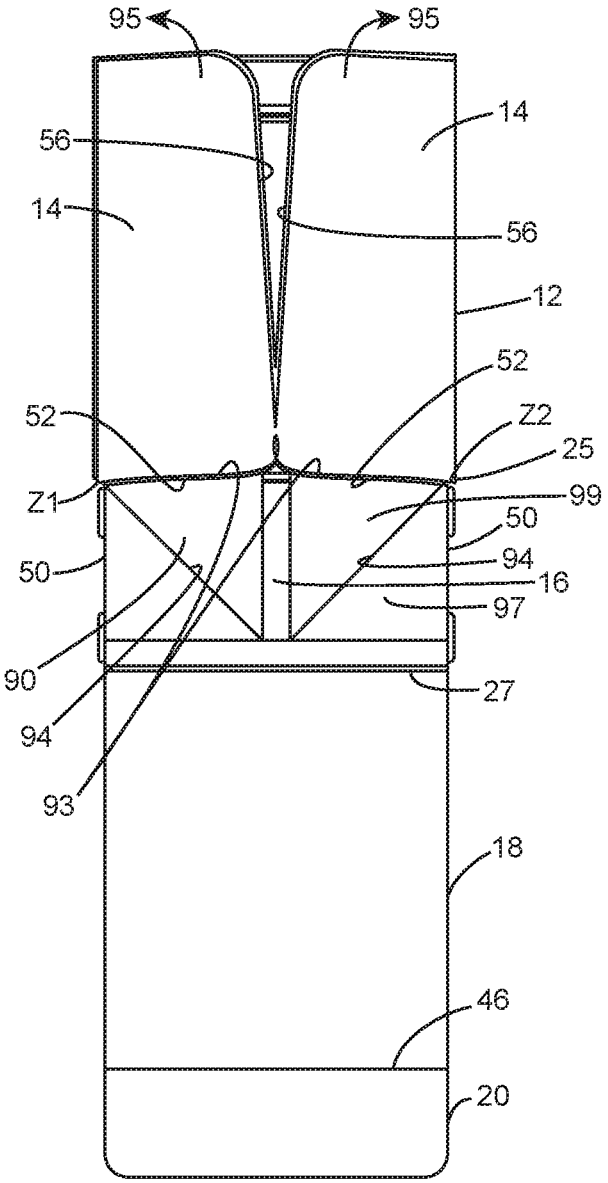
FIG. 4C is a front view of the foldable suitcase of FIG. 4A.
Figure 4D:
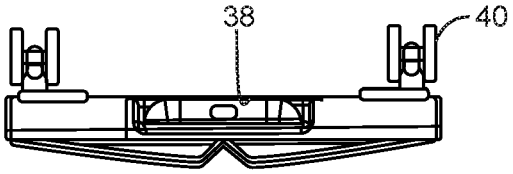
FIG. 4D is a top view of the foldable suitcase of FIG. 4A.
Figure 5A:
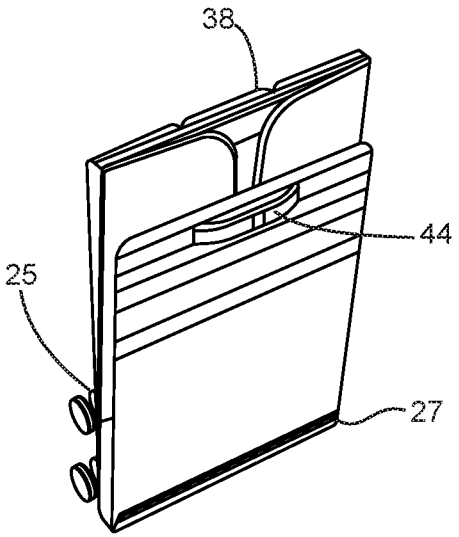
FIG. 5A is a front perspective view of the foldable suitcase of FIG. 1A, at a fully folded, overlapping position.
Figure 5B:
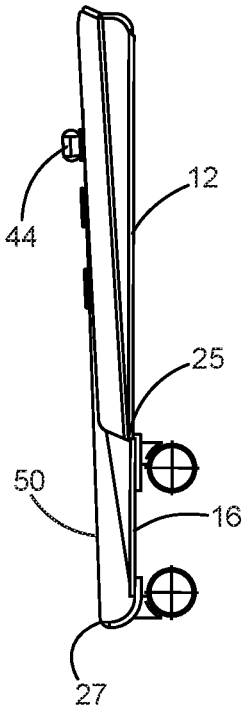
FIG. 5B is a right side view of the foldable suitcase of FIG. 5A.
Figure 5C:
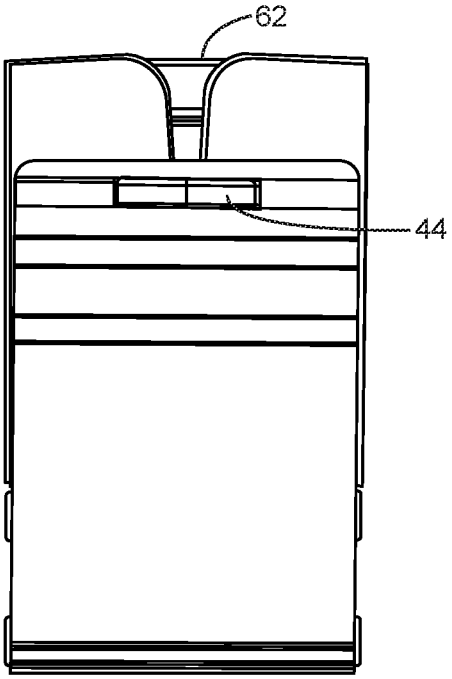
FIG. 5C is a front view of the foldable suitcase of FIG. 5A.
Figure 5D:
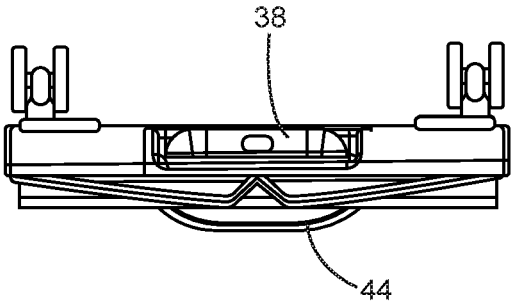
FIG. 5D is a top view of the foldable suitcase of FIG. 5A.
Figure 6A:
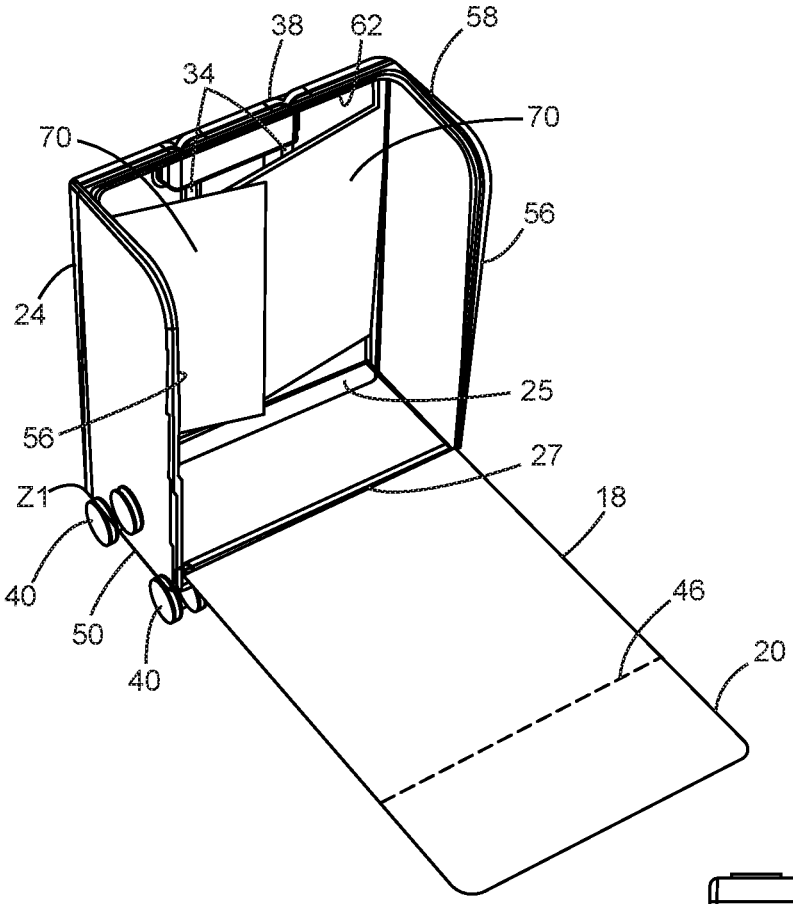
FIG. 6A is a front perspective view of the foldable suitcase of FIG. 1A, at an upright position, with the top and front wall at an open position, the two side walls at an erect position and side support panels at their folded position.
Figure 6B:
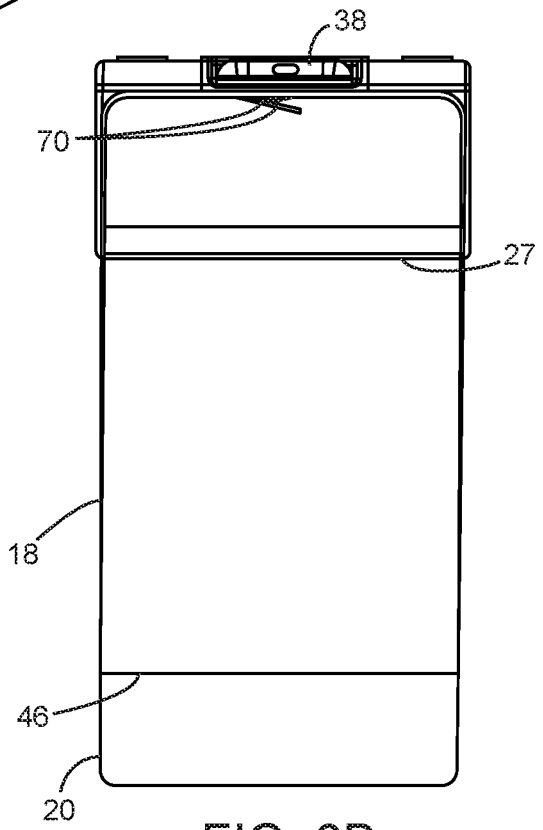
FIG. 6B is a top view of FIG. 6A.
Figure 7A:
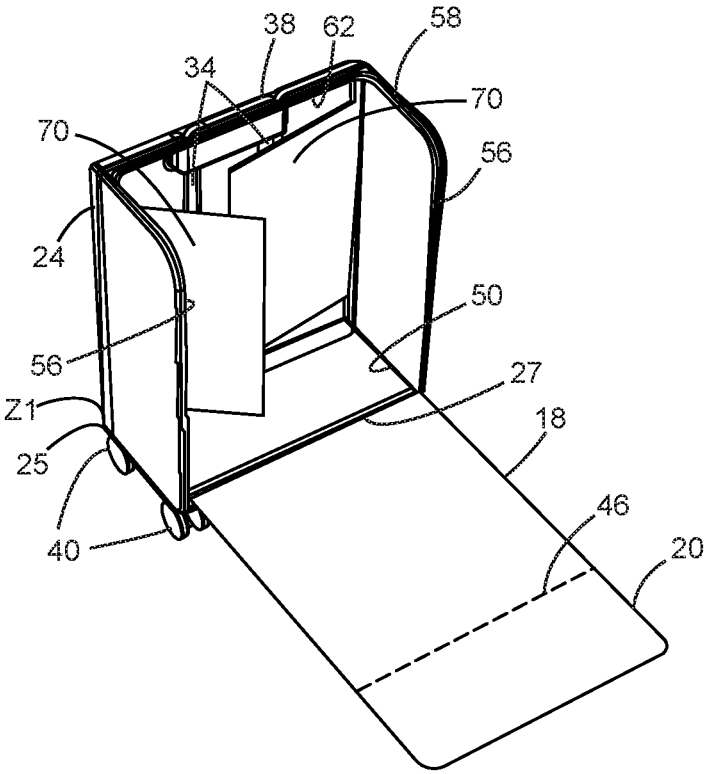
FIG. 7A is similar to FIG. 6A, exemplifying how side support panels are displaceable between a folded position and an erect, supporting position.
Figure 7B:
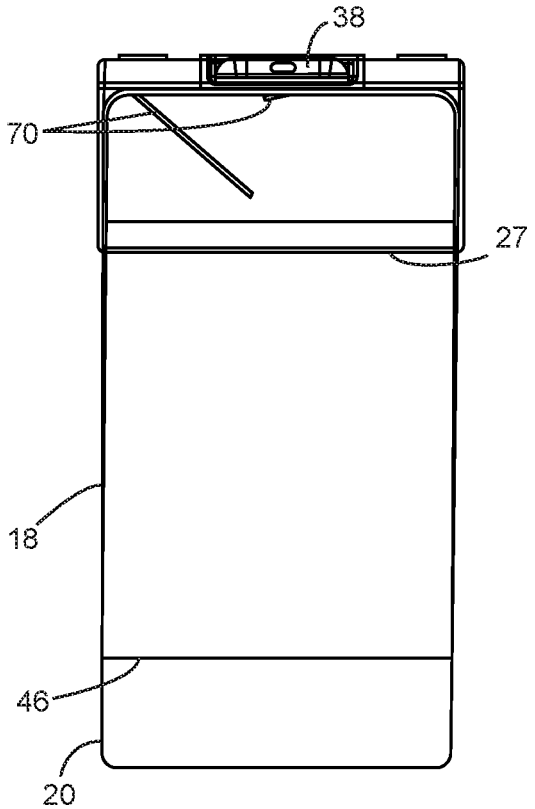
FIG. 7B is a top view of FIG. 7A.
Figure 8A:
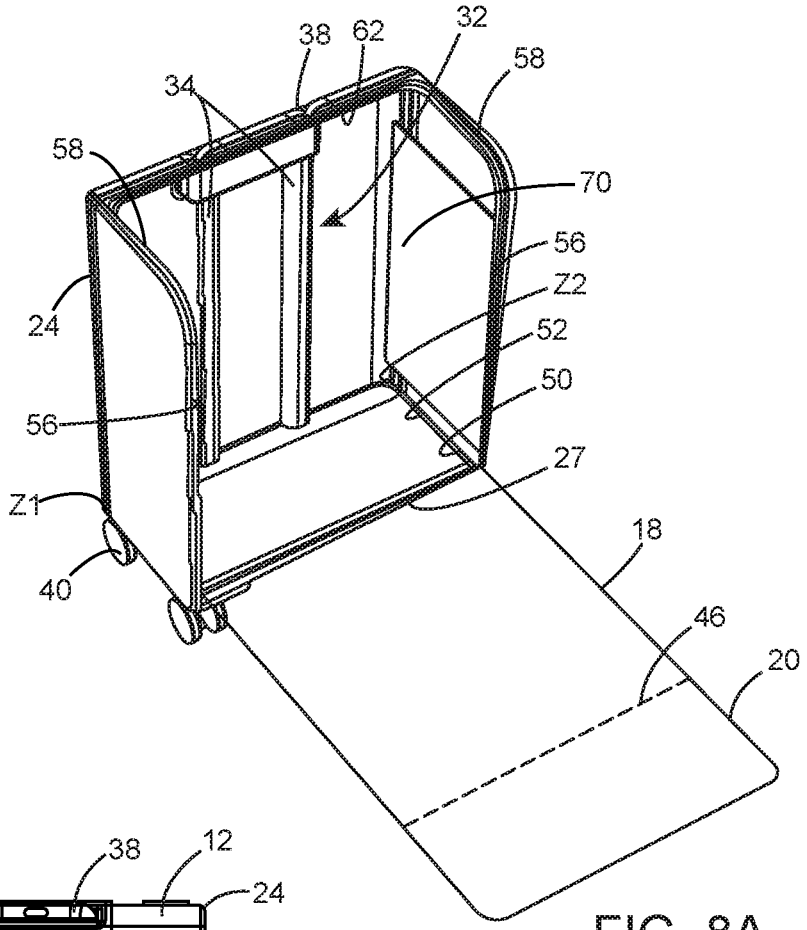
FIG. 8A is similar to FIG. 6A, exemplifying the side support panels at a fully erect, supporting position.
Figure 8B:
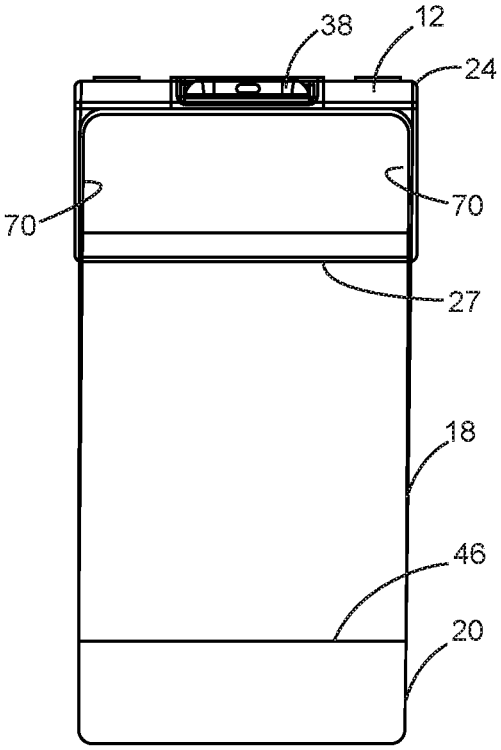
FIG. 8B is a top view of FIG. 8A.
Figure 8C:
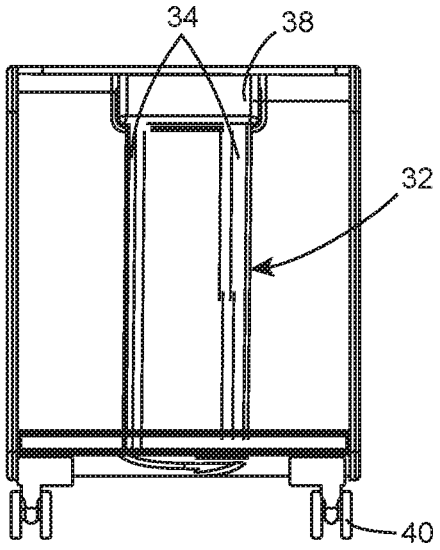
FIG. 8C is a back view of FIG. 8A.

The foldable suitcase 10 further comprises a closure arrangement configured for securing side edges 50 of the base wall 16 to bottom edges 52 of the respective side walls 14 (best realized in FIG. 4C). In the present examples, the closure arrangement is a zipper closure, continuously extending from two respect opposite sides, beginning at bottom back corner of the side walls (locations marked Z1 and Z2 in the drawings), along the bottom edge 52 of the side walls, further along the front edge 56 of the side walls 14, then onto the top edge 58 of the side walls and finally along a top edge portion 62 of the back wall 12, where two opposite zipper clasps 60 meet (location marked F in the drawings; best seen in FIGS. 10E and 10F), though it is appreciated that since the closure zipper is continuous, the two zipper clasps can in fact meet at any location along the zipper path.

Once the closure, e.g. zipper, is closed, the foldable suitcase being at the erect position, the structure becomes solid with the side walls 14 and the base wall 16 rigidly extending from the back wall 12, thus obtaining a firm and stable volumetric body.

As mentioned herein before, at least the back wall 12, both side walls 14 and the base wall 16 are rigid, wherein such rigidity is either inherent to each of these wall panels, or imparted thereto by a rigidifying member. A rigidifying member can be attached to a respective panel, either fixedly or detachably, and can thus be pivotally articulated for facilitating manipulation of the suitcase between its erect position and the folded/collapsed position. In the example of FIGS. 1A to 8C, the back wall 12 and the base wall 16 are inherently rigid, whilst the side walls 14 are rigidified by collapsible support side panels 70 (best seen in FIG. 6A at a partially collapsed position; in FIG. 7A at the fully collapsed position; and in FIGS. 8A and 8B at the erect position), wherein the support side panels 70 are rigid boards of material that at the erect position can be attached to an inside face of the side walls (e.g. by a hook and pile arrangement or other fastener), thereby supporting the side walls at the erect position and providing rigid walls such that the foldable suitcase can maintain its volumetric shape and stand at an upright position.

Figure 1B:
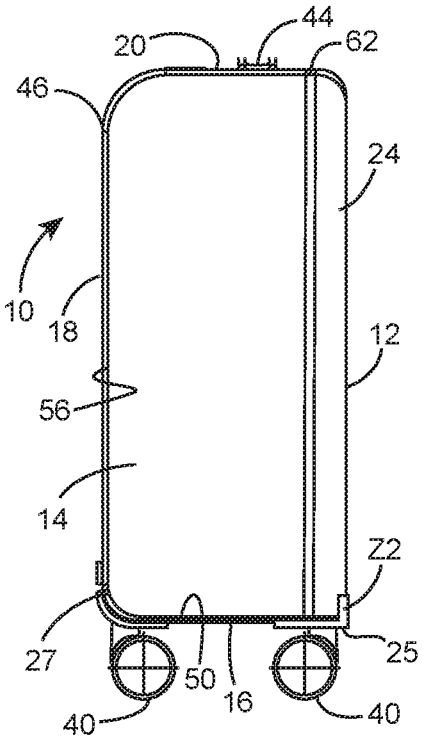
FIG. 1B is a side view of the foldable suitcase of FIG. 1A.
Figure 1C:
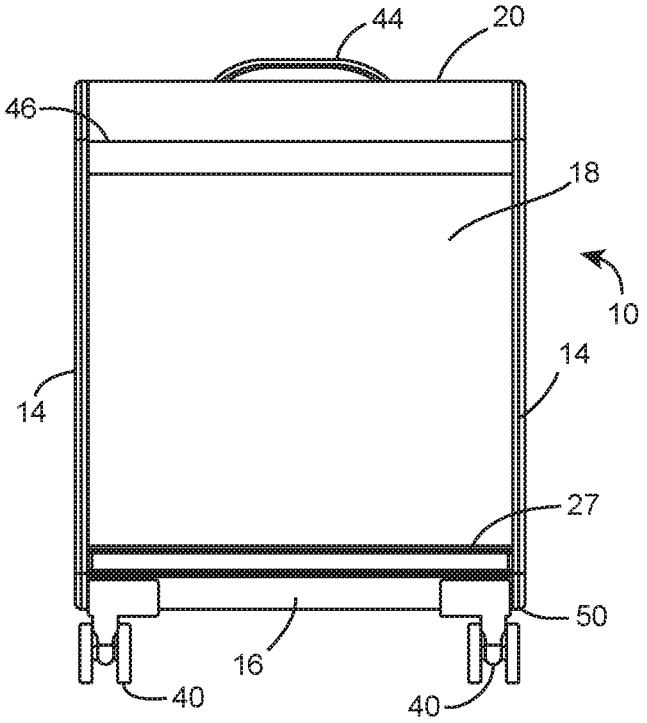
FIG. 1C is a front view of the foldable suitcase of FIG. 1A.
Figure 2A:
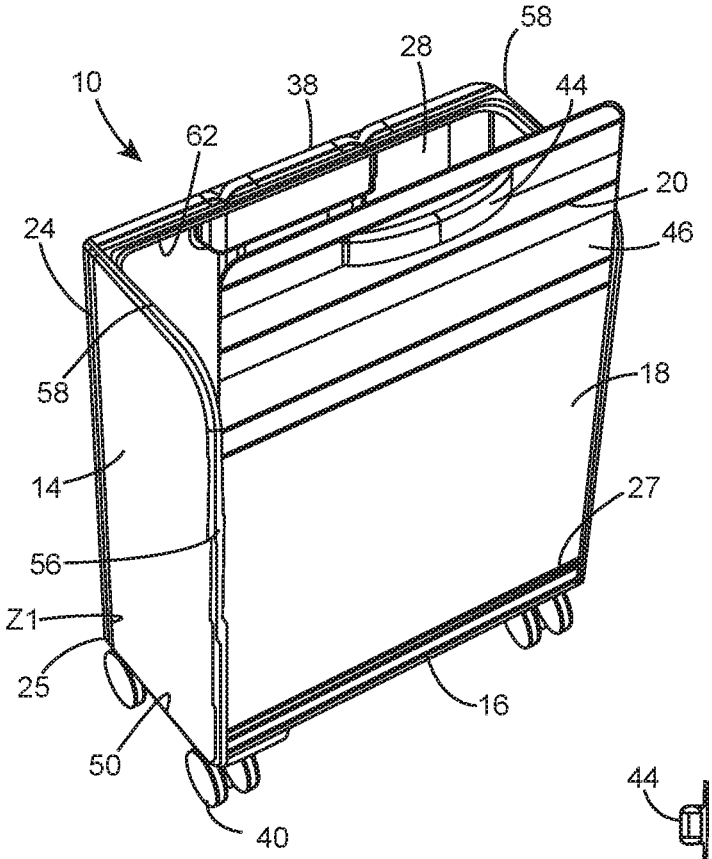
FIG. 2A is a front perspective of the foldable suitcase of FIG. 1A, with a top wall at an open position.
Figure 2B:
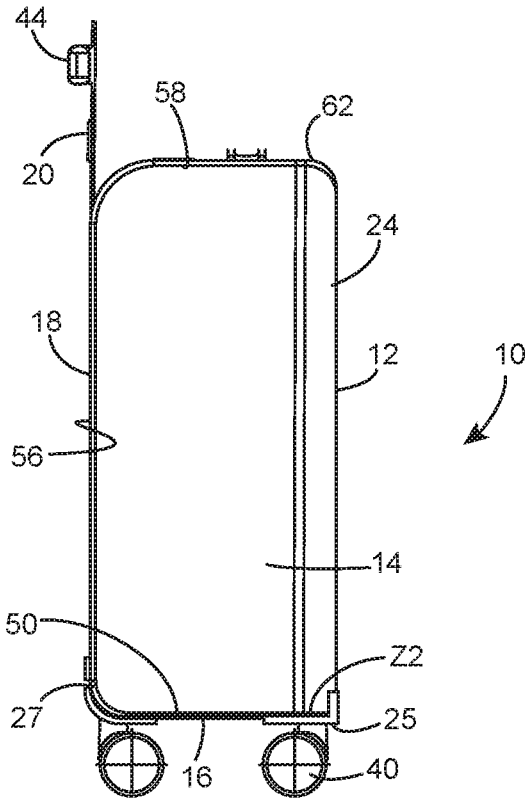
FIG. 2B is a right side view of the foldable suitcase of FIG. 2A.
Figure 3:
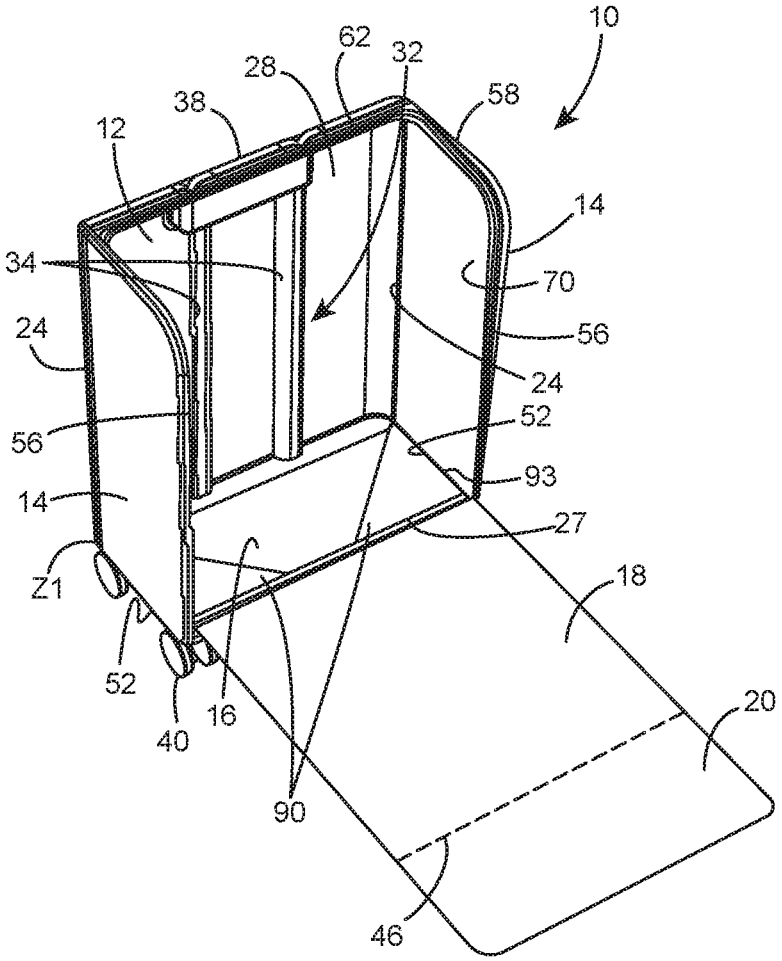
FIG. 3 is a front perspective view of the foldable suitcase of FIG. 1A, with a top wall and the front wall at an open position.

The foldable suitcase 10 is configurable between several positions. First is the erect, bodily position (e.g. as depicted in FIGS. 1A to 1C). Second is a first collapsed position (e.g. as depicted in FIGS. 4A to 4D) wherein the side walls 14 are folded over the back wall 12, whilst the base wall 16, the front wall 18 and the top wall 20 coextend from the bottom end of the back wall 12. At this position, the suitcase is the thinnest (corresponds with the maximal thickness of the back wall 12 and a single side wall 14 flush thereover) and this position can be suitable for storage e.g. by hanging in a closet, etc. Third is a second collapsed position (e.g. as depicted in FIGS. 5A to 5D) wherein the side walls 14 are folded over the back wall 12 and in turn the front wall 18 and the top wall 20 are disposed over the folded side walls 14, with the base wall 16 coextending with the back wall 12 and a respective portion of the front wall 18 bearing against the base wall 16. At this position, the thickness of the suitcase corresponds with the accumulated thickness of the base wall 12, and the thickness of a single side wall 14 and the front wall 16, disposed flush over one another.

If desired, the foldable suitcase 10 at either of the folded positions can be suspended from a hanger (not shown) and furthermore, a clasping arrangement can be configured (not shown) for retaining the suitcase at a folded position.

With further reference being made to FIGS. 9A to 9E, there is illustrated an arresting arrangement according to an embodiment of the disclosure, wherein elements of the suitcase already disclosed hereinabove are identified by same reference numbers. The arresting arrangement is configured for selectively securing the base wall 16 at the erect position a substantially right angle with respect to the back wall 12 (FIGS. 9A to 9D).

The arresting arrangement of FIGS. 9A to 9E comprises a first locking member 80 articulated at a rear portion of the inside face of the base wall 16, said first locking member 80 being a rigid block member housing a pair of arresting plungers 82 oppositely arranged and spring biased to project laterally from the first locking member 80 through an opening 84, wherein the arresting plungers 82 are manipulable between a normally projecting position (FIG. 9B) and a manually contacted position (FIG. 9D), upon finger squeezing of manipulator slider grips 88 towards one another, in direction of arrows 85. A free end 91 of the arresting plungers 82 in chamfered (slanted) so as to facilitate easy and self-locking with respective locking location 92 configured as an opening at a bottom of second locking members being said telescopically retractable legs 34 of the handle assembly 32, said locking location 92 disposed in register with the arresting plungers 82 at the locked position (i.e. when the base wall 16 is at the erect position).

Figure 9A:
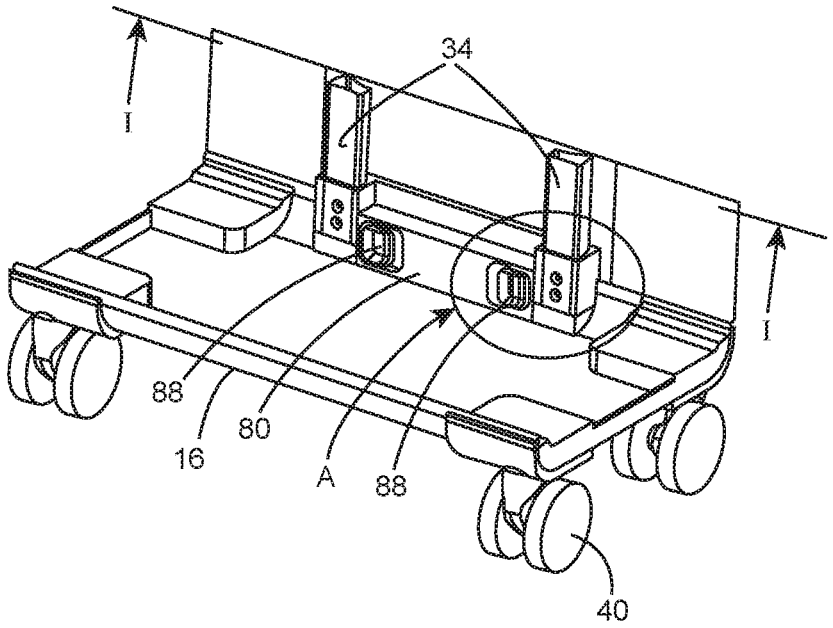
Figure 9B:
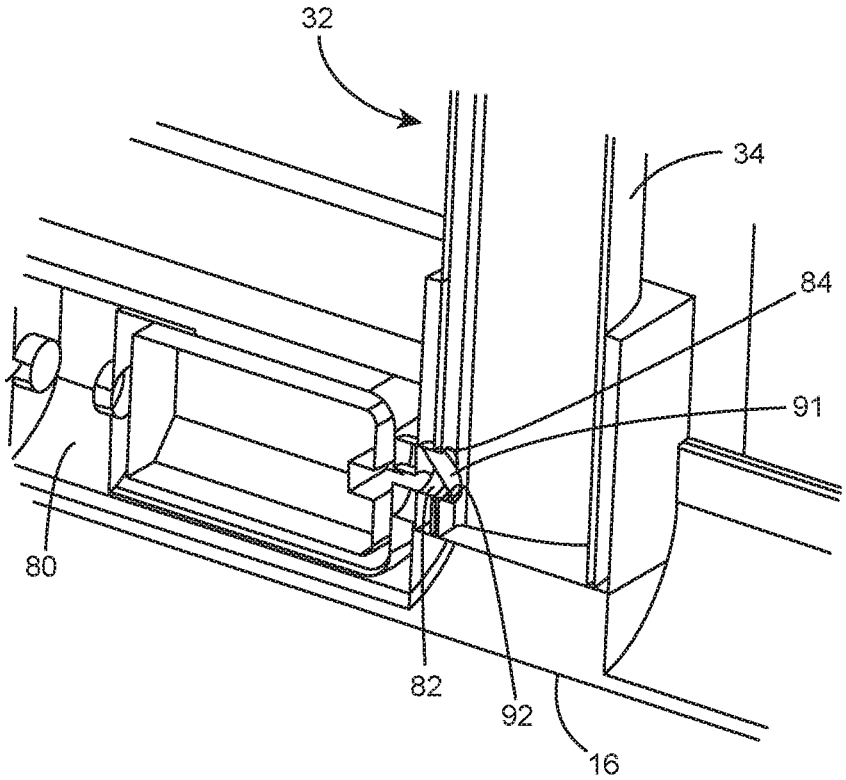
Figure 9C:
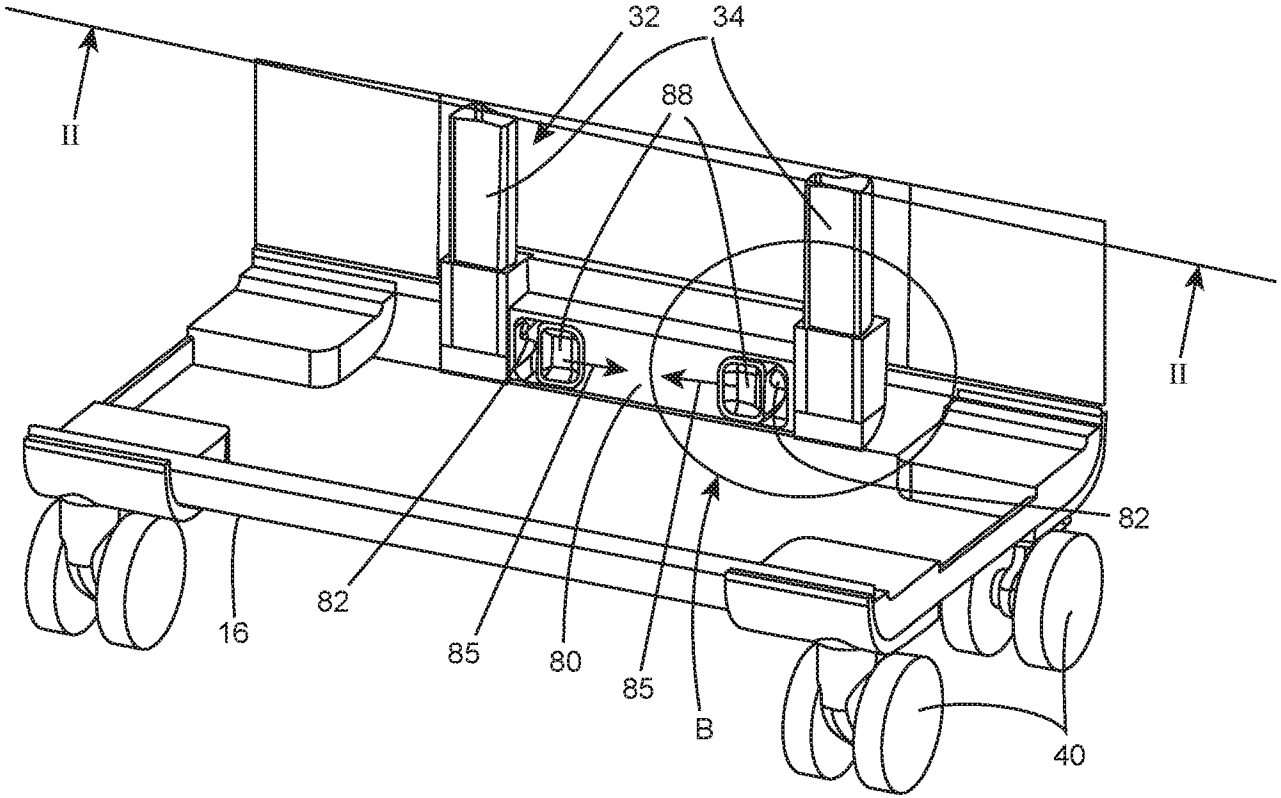
Figure 9D:
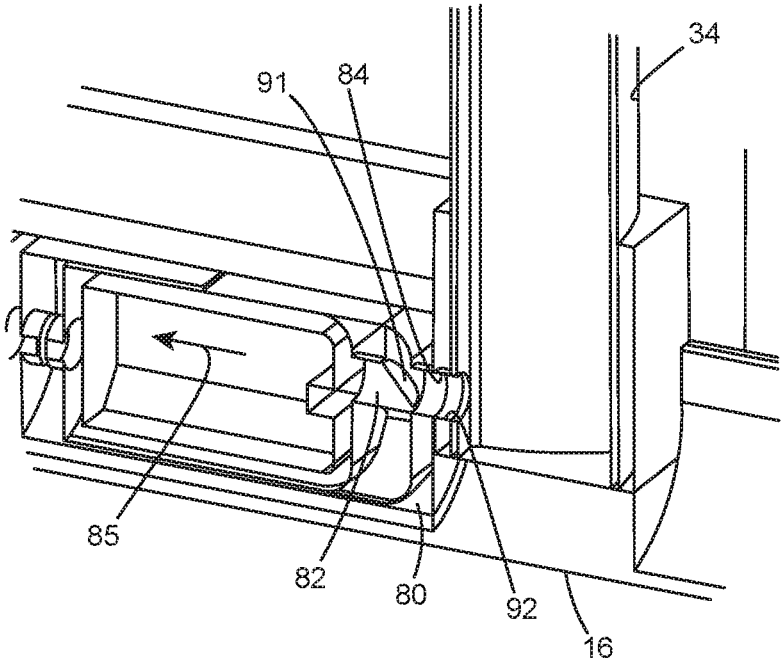
Figure 9E:
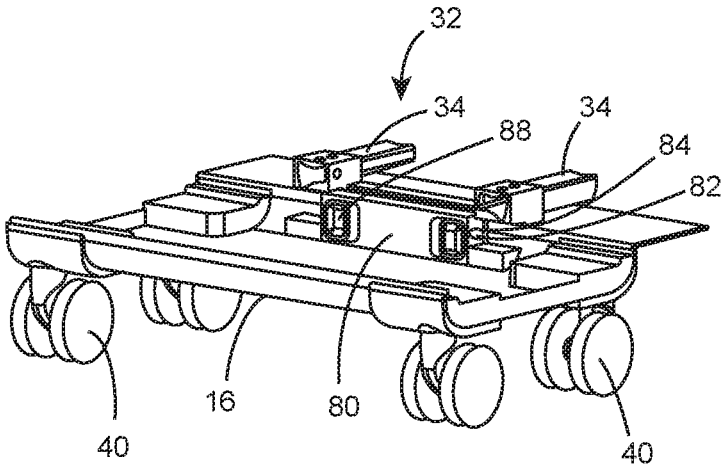

The arrangement is such that at the erect position (FIGS. 9A to 9D) the arresting plungers 82 are arrested within the locking location 92, thus preventing pivotal displacement of the base wall 16 with respect to the back wall 12. However, upon manipulating the slider grips 88 towards one another, the arresting plungers 82 retract and disengage from the locking locations 92 (FIG. 9C), whereby the base wall 16 can pivotally displace into the collapsed, unlocked position (FIG. 9E). Pivotal displacing (erecting) the base wall 16 into the fully erect position (disposed perpendicular to the back wall 12) entails spontaneous re-engaging of the arresting plungers 82 into the arresting locking locations 92. Arresting the base wall 16 at the erect position (with the arresting arrangement engaged respectively), gives rise to a rigid L-shaped chassis construction for supporting the entire suitcase erect and wherein the suitcase assumes a rigid and stable position rendering it suitable for carrying loads. Even more so, the base wall becomes articulated with the carrying handle assembly by engagement at the bottom portion of the telescopically retractable legs.

With further reference made back to FIGS. 1A to 8C and to FIGS. 10A to 10F, for exemplifying yet an arresting arrangement configurable for a foldable suitcase 10 according to an example of the disclosure, configured for supporting walls of the suitcase, namely side walls 14 and base wall 16, at an erect position with respect to the back wall 12.

As seen in some of the figures, and best in FIG. 4C, the foldable suitcase 10 is configured with yet an arresting arrangement comprising an arresting member 90 disposed over the base wall 16, at each side thereof, and each having a first edge 93 articulated to the bottom edge 52 of a neighboring side wall 14 through a living hinge, and a second edge 94 articulated through a living hinge along a portion of the base wall 16 and extending from a back corner of the base wall 16 (near location Z1 in the drawings) towards a front edge of the base wall 16, and wherein the length of the first edge 93 of the arresting member 90 does not exceed the depth of the base wall 16.

Figure 10B:
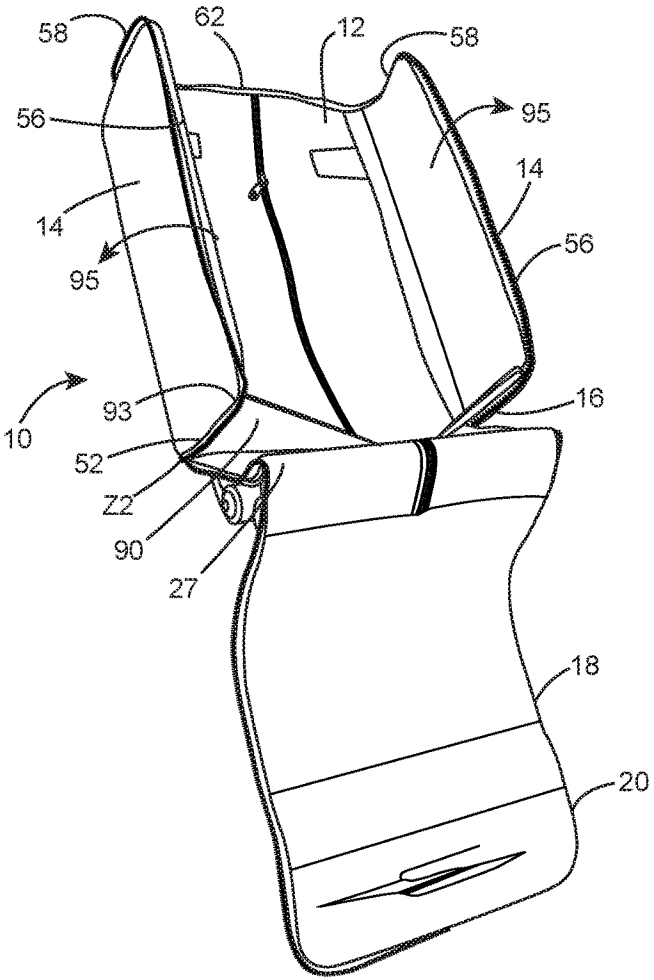
Figure 10A:
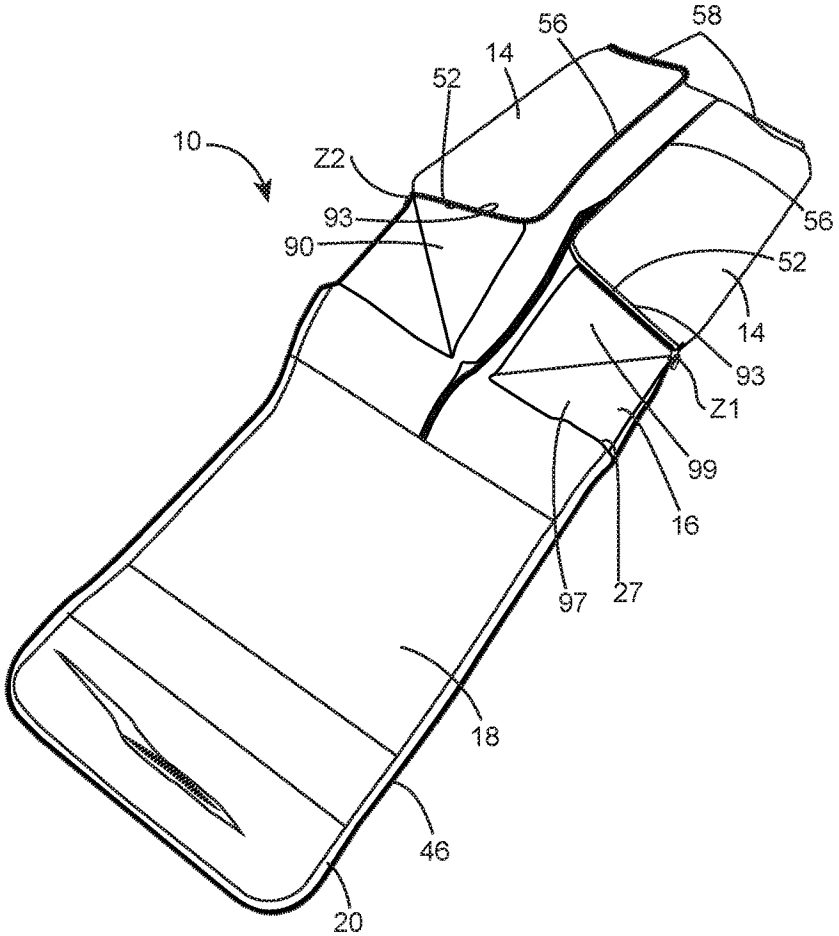
Figure 10D:
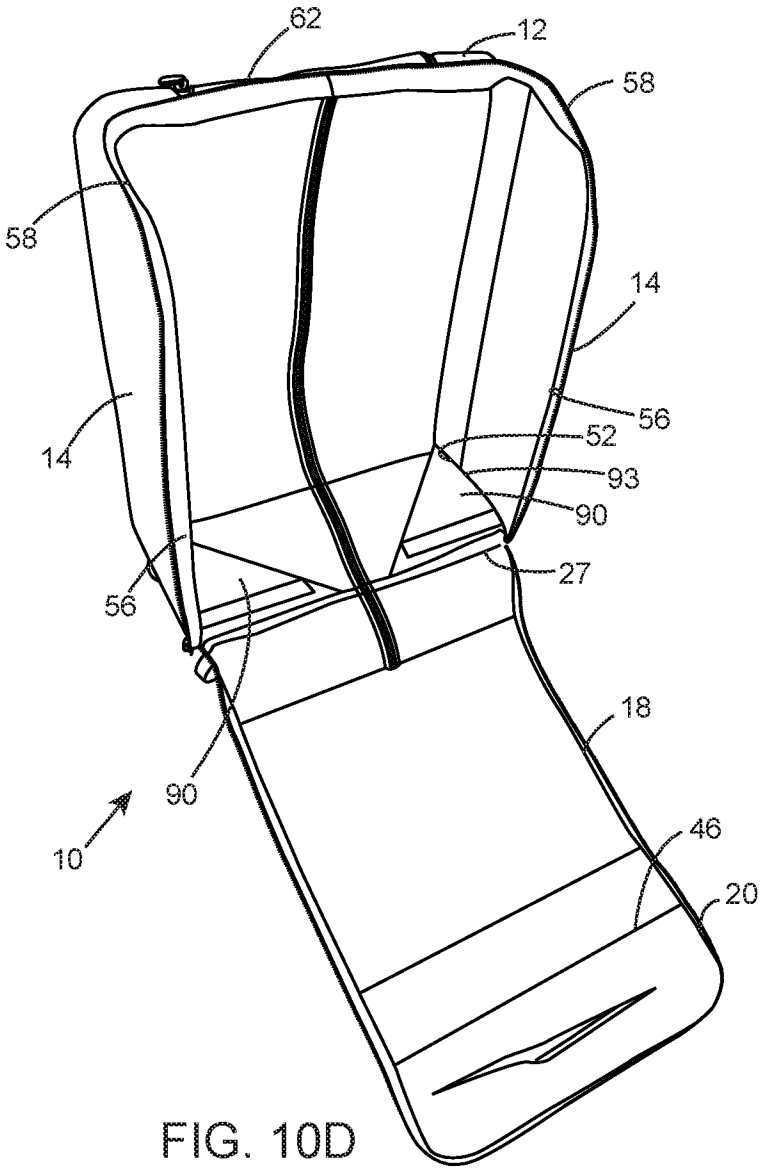
Figure 10C:
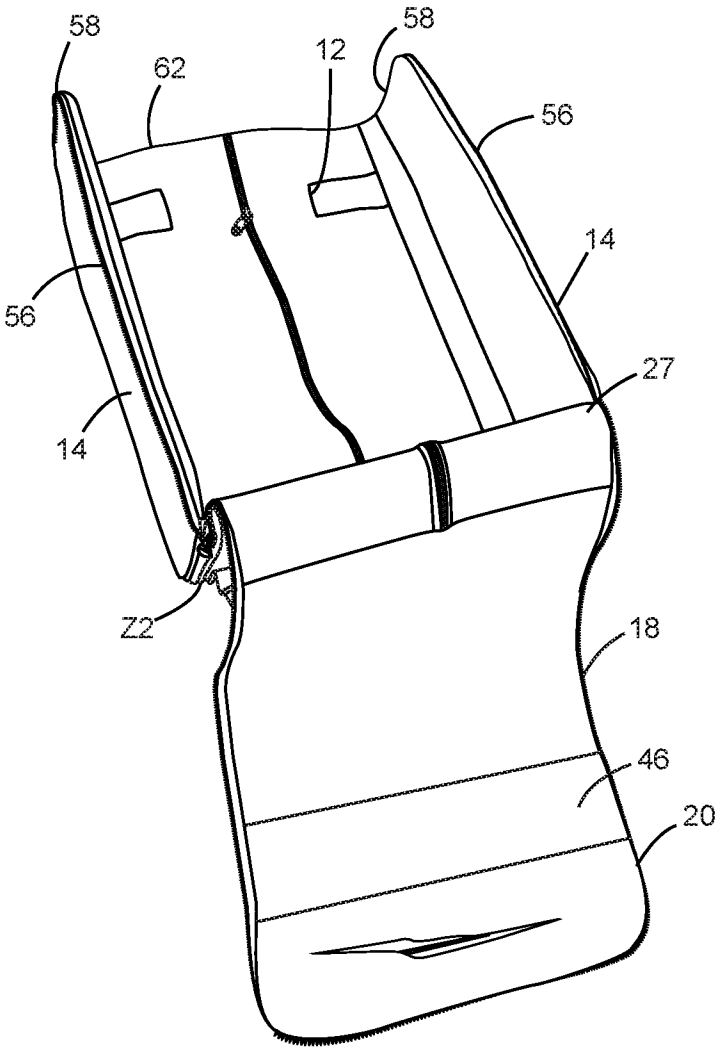
Figure 10F:
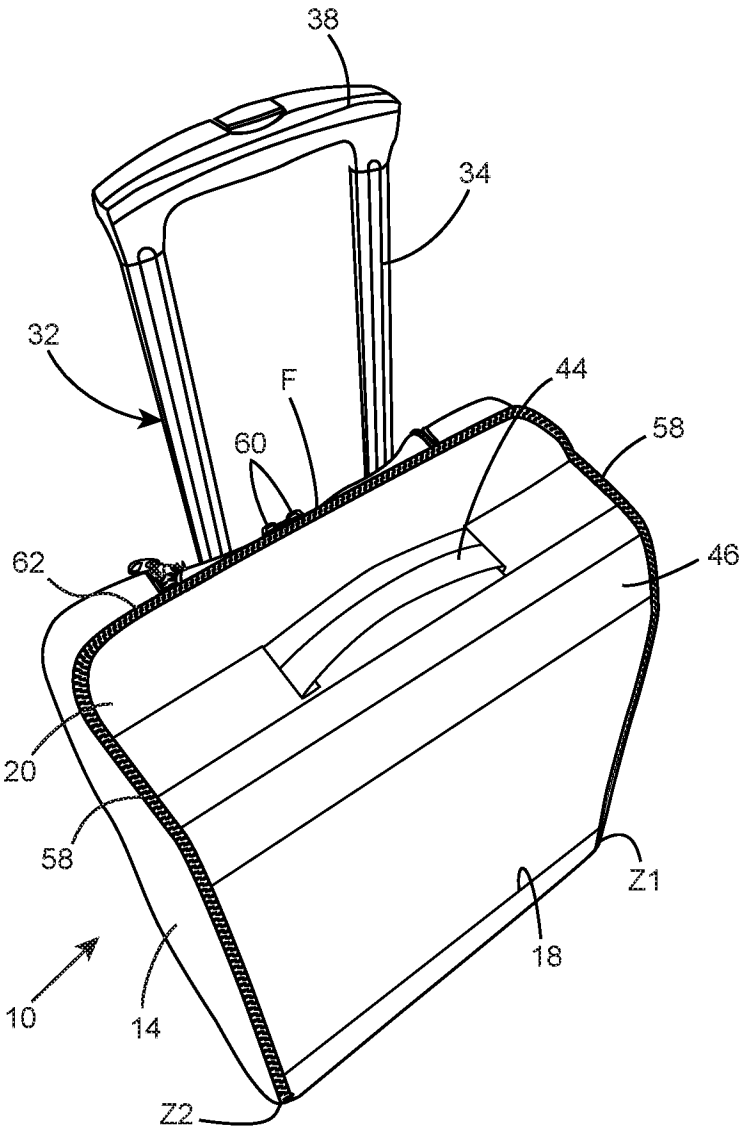
FIG. 10F is a front perspective view of FIG. 10E.
Figure 10E:
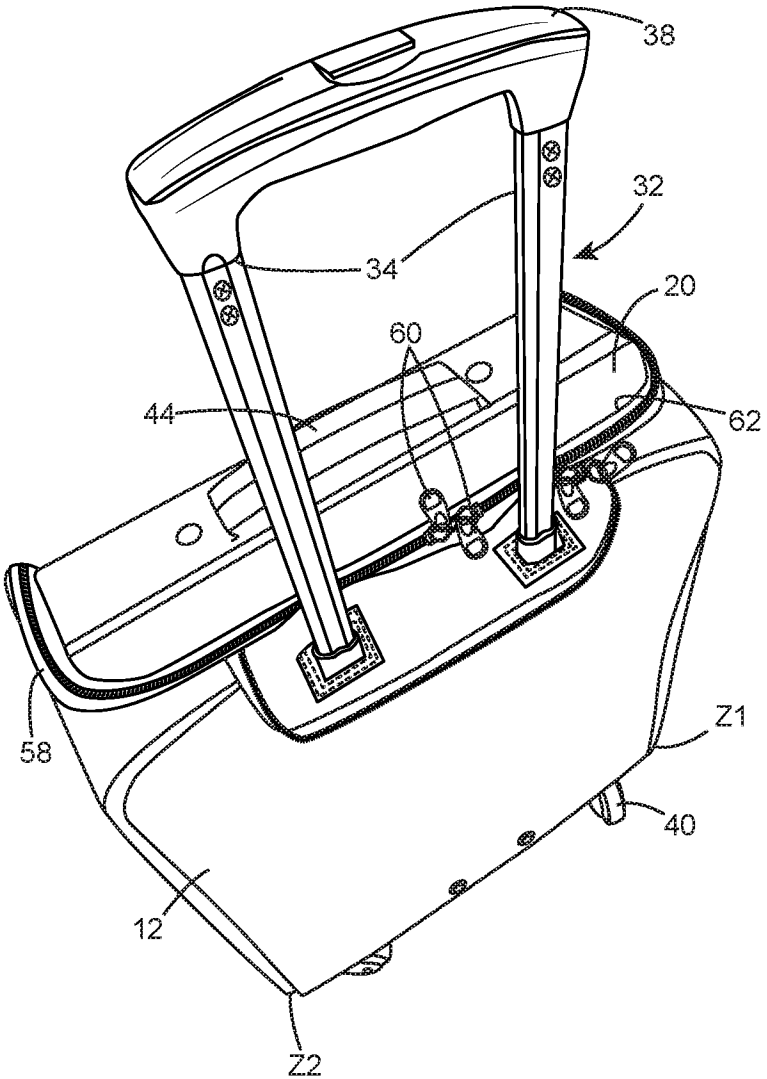

The arrangement is such that deploying the side walls 14 into the erect position, i.e. pivotal displacement in direction of arrows 95 (FIGS. 4C and 10B) entails spontaneous displacement of the base wall 16 into the erect position, as illustrated in FIGS. 10C and 10D.

In the illustrated example, the arresting member 90 is an isosceles right triangular member. However, it is appreciated that according to other designs the arresting member can assume other shapes. For example, the arresting member have a section of a triangular member, or be a rigid strap extending between the respective locations as described above.

The triangular arresting member in the illustrated example is an isosceles right triangular, wherein a hypotenuse thereof extending along a fold line 94 of the triangular member (extending from a bottom front corner of a side wall towards a front portion of the base wall).

As can best be seen in FIGS. 4A, 4C 10A and 10D, the triangular arresting member 90 illustrated in the drawings is configured out of a rectangle member having a diagonal living hinge extending along a fold line 94 defining two triangular portions 97 and a second triangular portion 99, wherein the first triangular portion 97 overlaps a front-side portion of the base wall 16, and the second triangular portion 99 has a first edge 93 articulated to a bottom edge 52 of a side wall 14 through a living hinge, and a second side thereof is free. The first triangular portion 97 is fixedly secured over a respective portion of the base wall 16, e.g. by riveting, stitching, hook and pile fastener, adhesive, etc.

It is appreciated that a fabric liner can be disposed along at least inside portions of the walls of the foldable suitcase 10. It is appreciated that whilst in the example the back wall and the base wall are rigid, and the side walls are rigid (or rigidified), and that the front wall and the top wall are flexible, however wherein once the foldable suitcase is at the erect position and the closure arrangement is secured, the suitcase assumes a sturdy three dimensional shape, with the flexible walls tensioned between edges of respective rigid walls, thus imparting the suitcase a sturdy erect position. The arrangement is such that the closure arrangement (zipper in the illustrated example) serves to tension the flexible wall portions over the rigid walls and to give rise to the sturdy erect position.

The invention claimed is:

1. A collapsible suitcase comprising a rigid back wall configured with a handle assembly, a front wall, two side walls, a top wall and a rigid base wall configurable at a bottom face thereof with a wheel set;

the two side walls are pivotally articulated to the back wall through living hinges along respective side edges of said back wall, and the base wall is pivotally articulated to the back wall through a living hinge along a bottom edge of said back wall, and wherein a closure arrangement is configured for securing side edges of the base wall to bottom edges of the respective side walls, and side edges of the front wall to a front edge of the respective side walls, and side edges of the top wall to top edges of the respective side walls, and a back edge of the top wall to a top edge of the back wall;

the suitcase further comprising an arresting arrangement disposed between the back wall and the base wall and configured for releasable securing the base wall at a substantially right angle with respect to the back wall, the arresting arrangement being configured with a first locking member at a bottom portion of the back wall, and a second locking member at a back portion of the base wall, wherein one or both of the first locking member and the second locking member is configured with an arresting location;

the suitcase is configurable between an erect position at which at least the side walls and the base wall are disposed substantially perpendicular to the back wall, and a collapsed position at which all walls are disposed substantially at parallel planes.

2. The suitcase of claim 1, wherein the top wall extends from a top edge of the front wall.

3. The suitcase of claim 1, wherein the base wall is displaceable between an erect position, at which it is disposed at a substantially right angle with respect to the back wall, and a collapsed position, at which it displaceable between a first unlocked position coextending with the back wall and a second unlocked position folded over a bottom portion of the base wall.

4. The suitcase of claim 1, wherein the arresting arrangement is configured for selectively securing the base wall at a substantially right angle with respect to the back wall, when the suitcase is at the erect position.

5. The suitcase of claim 1, wherein the arresting arrangement is configurable between a locked position, at which the base wall is secured at a right angle with respect to the back wall, and an unlocked position, at which the base member is pivotally displaceable between the erect position and a flat position at which it can coextend with respect to the back wall.

6. The suitcase of claim 5, wherein the arresting arrangement is configured for spontaneously engaging into the locked position upon pivotal displacement of the base wall into the erect position.

7. The suitcase of claim 1, wherein the arresting arrangement is configured as a rigid arresting member having a first edge articulated to a bottom edge of a side wall through a living hinge, and a second side articulated through a living hinge along a portion of the base wall and extending from a back corner of the base wall towards a front edge of the base wall.

8. The suitcase of claim 7, wherein the arresting member is a triangular member or have a section of a triangular member.

9. The suitcase of claim 7, wherein the arresting member is configured as a rectangle member having a diagonal living hinge defining a first triangular portion and a second triangular portion, wherein the first triangular portion overlaps a front-side portion of the base wall, and the second triangular portion has a first side is articulated to a bottom edge of a side wall through a living hinge, and a second side thereof is free.

10. The suitcase of claim 1, wherein deploying the side walls into the erect position entails spontaneous displacement of the base wall into the erect position.

11. The suitcase of claim 1, wherein the other of said one or both of the first locking member and the second locking member is configured with at least one locking plunger selectively manipulable between a locked position at which it engages with the arresting location, and an unlocked position at which it is disengaged from the arresting location, where at the locked position the base wall is pivotally fixed with respect to the back wall.

12. The suitcase of claim 11, wherein the first locking member and the second locking member are integral with or integrated with the respective wall portion.

13. The suitcase of claim 11, wherein the arresting arrangement is configured for spontaneously arresting of the at least one locking plunger with the arresting location upon displacement of the base wall into the erect position.

14. The suitcase of claim 1, wherein the arresting arrangement comprises a biased locking plunger normally projecting from a housing member of the base wall, said locking plunger is configured for arresting engagement within an arresting location at a housing member of the back wall.

15. The suitcase of claim 1, wherein the handle assembly extends along the back wall and is configurable between a retracted position and an expanded position.

16. The suitcase of claim 1, wherein the wheel set comprises at least a pair of wheels configurable at a back portion of a bottom face the base wall.

17. The suitcase of claim 1, wherein one or more of the walls of the suitcase is articulated to other walls of the suitcase through an integral or integrated living hinge.

18. The suitcase of claim 1, wherein the closure arrangement is selected from the group consisting of a set of clasps, a set of latches, a set of toggles, and a zipper.

19. The suitcase of claim 1, wherein at the collapsed position, the thickness of the suitcase substantially does not exceed accumulative thickness of the back wall and a side wall.

20. The suitcase of claim 1, wherein the back edge of the top wall extends from the top edge of the back wall.

21. The suitcase of claim 1, wherein a bottom edge of the front wall extends from a front edge of the base wall.

* * * * *